United States Patent [19]

Gössler

[11] 4,347,432

[45] Aug. 31, 1982

[54] GLASS CERAMIC COOKING APPLIANCE

[75] Inventor: Gerhard Gössler, Oberderdingen, Fed. Rep. of Germany

[73] Assignee: E.G.O. Elektro-Geräte Blanc u. Fischer, Fed. Rep. of Germany

[21] Appl. No.: 238,226

[22] Filed: Feb. 26, 1981

[30] Foreign Application Priority Data

Feb. 26, 1980 [DE] Fed. Rep. of Germany ..... 3007037

[51] Int. Cl.[3] ..... H05B 3/68

[52] U.S. Cl. ..... 219/449; 219/446; 219/452; 219/457; 219/466; 219/512; 337/394

[58] Field of Search ..... 219/445, 446, 448, 449, 219/452, 457, 459, 460, 464, 466, 508, 467, 512, 513; 337/354, 383, 386, 390, 393, 394

[56] References Cited

U.S. PATENT DOCUMENTS

| | | | |
|---|---|---|---|
| 2,104,848 | 1/1938 | Clark | 337/383 |
| 2,267,815 | 5/1981 | Gössler | 337/394 X |
| 3,412,236 | 11/1968 | Hild et al. | 219/413 |
| 3,906,424 | 9/1975 | Clancy et al. | 337/394 |
| 3,909,592 | 9/1975 | Eide | 219/462 |
| 4,008,454 | 2/1977 | Bowling | 219/512 X |
| 4,243,874 | 1/1981 | Fischer | 219/449 X |

FOREIGN PATENT DOCUMENTS

| | | | |
|---|---|---|---|
| 670890 | 1/1939 | Fed. Rep. of Germany | 337/383 |

*Primary Examiner*—Volodymyr Y. Mayewsky
*Attorney, Agent, or Firm*—Steele, Gould & Fried

[57] ABSTRACT

A glass ceramic cooking appliance having at least two separately switchable or combined switchable heating elements has a thermal cutout preventing overheating of the glass ceramic surface. A single temperature sensor acts on the thermal cutout and the sensor is subject to the influence of all the heating means elements. To ensure that the operating temperature of the glass ceramic hotplate is as close as possible to the permitted permanent operating temperature, the cutout operating temperature is detuned as a function of the nature and number of heating elements switched on in order to compensate for different thermal influences.

The temperature sensor can be an expansion sensor acting on a plurality of switches with different operating temperatures. Upon operating the heating elements a different switch is connected in series in each case to the individual heating elements.

10 Claims, 5 Drawing Figures

FIG. 1
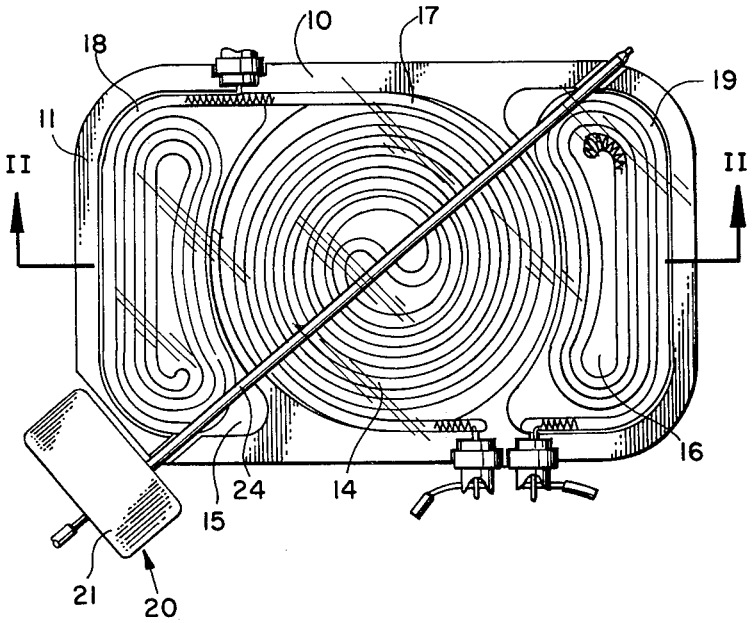
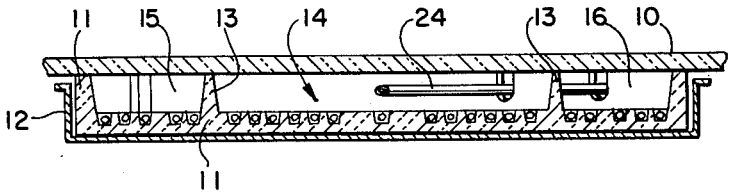
FIG. 2

GLASS CERAMIC COOKING APPLIANCE

BACKGROUND OF THE INVENTION

The invention relates to a glass ceramic cooking appliance with at least two switchable heating means.

There has always been a problem in preventing glass ceramic hotplates from overheating of all areas thereof. Thermal cutouts are often used, connected to a thermostat, which switches the heating means off on exceeding a predetermined temperature. If individual switchable heating means are used, a separate thermal cutout have always been provided for each heating means to prevent overheating in the vicinity thereof. However, this increases costs and requires a relatively large amount of space, which is often not available.

It has already been proposed to use a rod-like thermosensor running over all the heating means and which operates a single temperature-dependent cutout. The latter is set in such a way that when a single heating means is operating the permitted temperature is not exceeded. If, however, two heating means are being operated the heat given off by said two heating means acts on a greater length of the thermostat, so that the latter expands to a greater extent. As a result disconnection takes place at a somewhat lower temperature. Although this reliably prevents heating in the maximum permitted temperature, a lower no-load temperature is obtained when all these heating means are switched on.

SUMMARY OF THE INVENTION

The object of the invention is to provide a simply constructed, inexpensively manufactured and fault-proof appliance of the aforementioned type with which the operating temperature can be adjusted with maximum precision to a maximum permitted permanent operating temperature, without exceeding the maximum temperature in any part of the appliance and independently of the number of heating means switched on.

The invention achieves this object by an appliance of the aforementioned type in which a temperature sensor is controllable by each heating means which acts on a sole thermal cutout operable in response to the temperature sensor, and whose operating temperature is variable together with the switching on and off of the heating means. This makes it possible to bring about an accurate temperature limitation in the case of a predetermined, permitted permanent operating temperature with the aid of only one sensor. The sensor can be a resistor with a positive temperature coefficient which, on exceeding a predetermined resistance value, brings about a disconnection or a reduction of the power supply to the heating means. However, it is particularly advantageous if the sensor is constructed as an expansion sensor passing over all the heating means and which acts on at least two switches opening at different operating temperatures. Upon switching on of one heating means or a combination of heating means an associated switch can be switched in series to the heating means.

By means of these various cutouts it is possible to compensate for the varying thermal influence of the individual heating means on the temperature sensor.

According to a further development of the invention, upon switching on heating means with different thermal influence on the sensor, switches with different operating temperatures can be switched on. Thus, it is possible to use the same switch if two different heating means have the same thermal influence on the temperature sensor.

In the case of glass ceramic appliances it is often possible to switch on combinations of heating means. According to the invention upon switching on a combination of heating means it is possible to operate a switch associated with the combination. Here again switches with different operating temperatures are used upon switching on combinations with varying thermal influence on the temperature sensor.

It is also important, as is further proposed by the invention, that the switch with the lowest operating temperature is associated with the heating means having the smallest thermal influence on the thermostat.

To ensure maximum simplicity of the circuitry the invention proposes that the switch with the lowest operating temperature is always in series with the heating means and the other switches can be operated in parallel thereto. Thus, the switch with the lowest operating temperature is switched on upon switching on the appliance. If switches with higher operating temperatures are connected in parallel thereto, there is no need to disconnect the switch with the lower operating temperature, because it is short-circuited by the switch opening at the higher temperature.

However, it is also possible, as is further proposed by the invention, for all switches to be connected in series with one another and with the heating means, so that the individual switches, optionally with the exception of the switch having the highest operating temperature, can be bridged by switching on the heating means.

According to a further development, the switches may be snap switches. It is also possible to use double snap switches operating at different temperatures.

BRIEF DESCRIPTION OF THE DRAWINGS

Further features, details and advantages of the invention can be gathered from the claims, combinations of claims and the following description of preferred embodiments of the invention with reference to the drawings, wherein:

FIG. 1 is a top plan view of a hotplate with the glass ceramic plate removed.

FIG. 2 is a section along the line II—II of FIG. 1.

DETAILED DESCRIPTION OF THE PREFERRED EMBODIMENTS

Figure 3:
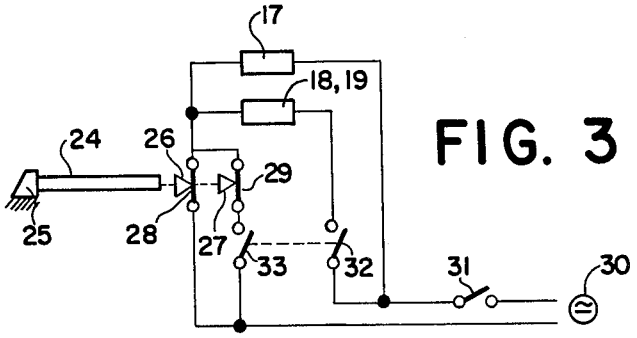
FIG. 3 is a circuit diagram of the arrangement according to FIGS. 1 and 2.

A glass ceramic cooking appliance is shown in FIGS. 1 and 2, comprising a supporting tray 11 located in a sheet metal tray 12. Supporting tray 11 includes webs 13, extending up to the glass ceramic plate 10, and dividing the supporting tray 11 into three thermally separated areas 14, 15 and 16, which are thereby shielded from one another against thermal radiation. The individual areas contain heating means 17, 18, 19 which comprise heating resistors in the form of wire coils.

A thermal cutout 20 for limiting the temperature is provided below the glass ceramic plate. The thermal cutout contains a switch member 21 disposed alongside one corner of the tray and a long, rod-shaped temperature sensor 24 projecting diagonally over the entire supporting tray, beneath the ceramic glass plate. The sensor 24 comprises a quartz glass expansion sleeve and a metal rod having a greater thermal expansion located therein. The construction of such sensors is known in the art, typical examples being illustrated in U.S. Pat. Nos. 3,412,236 and 4,267,815.

It can be seen from FIG. 1 that the sensor passes over all the heating means 17, 18 and 19. The heat emanating from the individual heating means therefore in each case leads to a zonal heating of the thermostat. If, for example, heating means 17 is switched on, then the heat action mainly acts on the part of sensor 24 passing over said area. This leads to a smaller expansion of the complete temperature sensor than in the case when heating means 18 and 19 were also in operation.

FIG. 3 is the circuit diagram for the glass ceramic plate of FIG. 1. Snap switches 28 and 29, shown diagrammatically in FIG. 3, are disposed within the housing of switch member 21. It is assumed that heating means 18 and 19 can only be switched on together, and then only in addition to the heating means 17.

The sensor 24 is shown diagrammatically. Its left-hand end is secured by an abutment 25, so that a heating of sensor 24 leads to an extension thereof and consequently to a displacement to the right of its right-hand end. Two operating members 26 and 27 are connected to the right-hand end of sensor 24. Operator member 26 serves to operate the first snap switch 28 and operating member 27 to operate the second snap switch 29. In order to show that the switch 29 only opens in the case of a greater extension of sensor 24, i.e. at a higher temperature, the distance between the two operating members 26 and 27 is somewhat smaller than the distance between the two switches 28 and 29.

The heating means of the glass ceramic cooking appliance receive voltage from a power supply 30, which is only diagrammatically shown. Master switch 31, which can be a manually operable switch and also the switch of a power control device is used for switching on purposes. On closing switch 31 power is supplied to heating means 17, which heats the central part in FIG. 1. The first switch 28, which is closed when sensor 24 is cold is arranged in series with heating means 17. Thus, a current flows through heating means 17, which consequently heats temperature sensor 24. On reaching the critical temperature, the operating member 26 opens switch 28, so that the power flow through heating means 17 is interrupted.

If switch 32 for heating means 18 and 19 is closed when switch 31 is closed, switch 33 which is mechanically connected to switch 32 connects the second thermal cutout 29 in parallel with the first thermal cutout 28. As now both heating means 17 and 18, 19 act on sensor 24, the latter is lengthened to a somewhat greater degree than when subject only to the action of heating means 17. Thus, for the same surface temperature of the glass ceramic hotplate this leads to a greater expansion of sensor 24. Thus, if the latter opens switch 28 while the critical temperature has still not been reached, the appliance continues to be heated because the parallel-connected cutout 29 is still closed. Only on further expansion of temperature sensor 24 does operating member 27 open the thermal cutout 29, which leads to an interruption of the power supply to both the heating means 17 and 18, 19.

Figure 4:
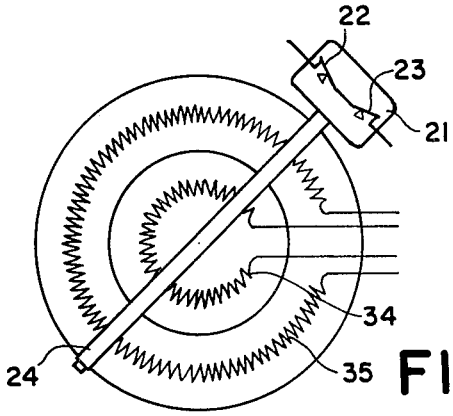
FIG. 4 is a diagrammatic plan view of another embodiment.

FIG. 4 shows a different arrangement of two individual switchable heating means 34 and 35 for a glass ceramic hotplate. Sensor 24 is positioned along a diameter to the two concentrically arranged heating means 34 and 35. Two snap switches 22 and 23 combined here to form a double snap switch are housed in the switch member 21. If sensor 24 expands firstly one snap switch, e.g. snap switch 22 is opened, while in the case of further expansion the other snap switch 23 also opens.

Figure 5:
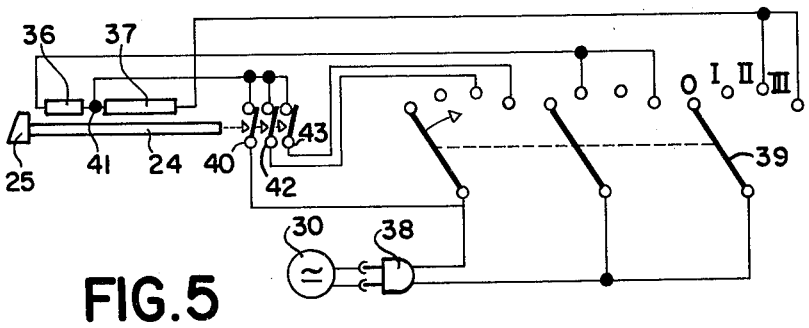
FIG. 5 is a further circuit diagram.

FIG. 5 is a circuit diagram for two heating means 36 and 37 which, in the present embodiment, can be operated individually and together. The power supply 30 and plug 38 are responsible for the power supplied to the switching means. Heating means 36 and 37, as well as the corresponding thermal cutouts, are operated with the aid of a rotary switch 39, which comprises three, mechanically interconnected, individual switches. In position 0 of switch 39 the appliance is off. In position I heating means 36 is on, which has a smaller thermal influence on the sensor than heating means 37. On switching on heating means 36 the thermal cutout 40 with the lowest operating temperature is also in series with heating means 36, because it connects the circuit point 41 common to the two heating means 36 and 37 with one pole of power supply 30.

In position II of switch 39 heating means 37 is switched on and simultaneously the thermal cutout 42 is connected in series with heating means 37. Thermal cutout 42 has a higher operating temperature than cutout 40.

In position III of switch 39 the two heating means 36 and 37 are on and at the same time thermal cutout 43 is connected in series with the two heating means 36 and 37. Cutout 43 has an higher operating temperature than cutout 42.

Instead of the described and represented parallel connection of the individual cutouts in which the switches with the lowest or lower operating temperature remain connected in parallel, while the cutout with the higher operating temperature is switched in, it is also possible to use a series-connection of the individual thermal cutouts, there being a bridging of the individual cutouts in each case.

In the case of an embodiment corresponding to FIG. 5 in which, for example, the heating means 36 and 37 exert the same thermal influence on thermostat 24, the same thermal cutout could be used for positions I and II of switch 39.

It is naturally also possible to combine a plurality of heating means for a glass ceramic cooking appliance into groups of heating means, each group forming a cooking unit. The measures according to the invention can then be used for each cooking unit.

I claim:

1. A glass ceramic cooking appliance, comprising:

a glass ceramic cooking surface; at least two electric heating means for the cooking surface;

means for individually switching the at least two heating means on and off;

a temperature sensor subject to the thermal influence of each of the at least two heating means; and a thermal cutout, operable in response to the temperature sensor, and having a variable operating temperature which can be changed in response to the switching means; and, an insulating tray the at least two heating means and the switching and thermally separating the at least two heating means.

2. A glass ceramic cooking appliance according to claim 1, wherein the thermal cutout is operable at any one of a plurality of operating temperatures, each of the operating temperatures corresponding to the thermal influence of each of the at least two heating means and each combination thereof.

3. A glass ceramic cooking appliance according the claims 1 or 2, wherein the temperature sensor and the at least two heating means are so arranged that each of the at least two heating means and each combination thereof has a different thermal influence on the temperature sensor, the thermal cutout having different operating temperatures corresponding to the different thermal influences on the temperature sensor.

4. A glass ceramic cooking appliance according to claim 2, wherein the lowest of the operating temperatures is associated with that one of the at least two heating means having the smallest thermal influence on the temperature sensor.

5. A glass ceramic cooking appliance to claim 3, wherein the lowest of the operating temperatures is associated with that one of the at least two heating means having the smallest thermal influence on the temperature sensor.

6. A glass ceramic cooking appliance according to claim 1, wherein the temperature sensor is a rod-shaped expansion sensor passing over each of the at least two heating means and wherein the thermal cutout comprises at least two cutout switches opening at different operating temperatures, each of which can be connected in series with at least one of the at least two heating means in response to the switching means.

7. A glass ceramic cooking appliance according to claim 6, wherein the temperature sensor and the at least two heating means are so arranged that each of the at least two heating means has a different thermal influence on the sensor, the different operating temperatures of the at least two cutout switches corresponding to the different thermal influences.

8. A glass ceramic cooking appliance according to claim 7, wherein the cutout switch with the lowest of the operating temperatures is associated with that one of the at least two heating means having the smallest thermal influence on the temperature sensor.

9. A glass ceramic cooking appliance according to claim 8, wherein the cutout switch with the lowest of the operating temperatures is always in series with each of the at least two heating means and the other of the at least two cutout switches are switchable in parallel therewith.

10. A glass ceramic cooking appliance according to claim 6, wherein the cutout switches are snap switches.

* * * * *

UNITED STATES PATENT AND TRADEMARK OFFICE

CERTIFICATE OF CORRECTION

PATENT NO. : 4,347,432

DATED : August 31, 1982

INVENTOR(S) : Gerhard Gössler

It is certified that error appears in the above-identified patent and that said Letters Patent are hereby corrected as shown below:

On The Title Page,

In the Abstract, line 6, delete "means".

Column 4, line 63, after "tray" insert --supporting--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*